US006675607B2

(12) United States Patent
Tarutani et al.

(10) Patent No.: US 6,675,607 B2
(45) Date of Patent: Jan. 13, 2004

(54) SWASH PLATE TYPE COMPRESSOR

(75) Inventors: Tomoji Tarutani, Kariya (JP); Hirohiko Tanaka, Kariya (JP); Hisato Kawamura, Kariya (JP); Kenji Mochizuki, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 10/292,135

(22) Filed: Nov. 12, 2002

(65) Prior Publication Data

US 2003/0089123 A1 May 15, 2003

(30) Foreign Application Priority Data

Nov. 12, 2001 (JP) ..... 2001-346443

(51) Int. Cl.[7] ..... F25B 43/02; F25B 15/00; F25B 31/00; F04B 1/12

(52) U.S. Cl. ..... 62/469; 62/84; 62/470; 62/193; 417/269

(58) Field of Search ..... 62/469, 84, 470, 62/193; 417/269

(56) References Cited

U.S. PATENT DOCUMENTS 5,478,212 A * 12/1995 Sakai et al. ..... 417/269
5,730,249 A * 3/1998 Shimizu ..... 184/6.17
6,237,362 B1 * 5/2001 Jang ..... 62/469

FOREIGN PATENT DOCUMENTS

JP 06-123280 5/1994 ..... F04B/27/08
JP 07-189902 7/1995 ..... F04B/27/14

OTHER PUBLICATIONS

Patent Abstracts of Japan corresponding to Japanese Laid-Open Publication No. 7–189902, 6–123280.

* cited by examiner

*Primary Examiner*—William C. Doerrler
*Assistant Examiner*—Filip Zec
(74) *Attorney, Agent, or Firm*—Morgan & Finnegan, LLP

(57) ABSTRACT

An oil separator is provided on a bleeding channel inside the shaft 16. By integral rotation of the shaft 16 and a rotary valve, oil contained in a refrigerant gas is centrifuged via the oil separator. The separated oil is supplied to an interface between the rotary valve and a cylinder block, namely, a clearance portion of the rotary valve. The separated oil is also supplied into a clearance between a piston and a cylinder bore 12*a* via a suction port and a suction channel.

9 Claims, 4 Drawing Sheets

SWASH PLATE TYPE COMPRESSOR

BACKGROUND OF THE INVENTION

The present invention relates to a swash plate type compressor used in an air conditioner for a vehicle. Particularly, the present invention relates to a swash plate type compressor using a rotary valve for supplying a refrigerant gas into a gas compression chamber.

For example, in a swash plate type compressor disclosed in Japanese Patent Laid-Open No. 7-189902, single headed pistons are housed in a plurality of cylinder bores arranged around a rotary shaft extending through the center of a housing. Each piston linearly reciprocates in the corresponding cylinder bore. Further, in the housing, a swash plate is tiltably supported by the rotary shaft. The swash plate converts a rotational movement of the rotary shaft into a reciprocating motion of the pistons. The compressor includes a rotary valve for selectively supplying a refrigerant gas into compression chambers, each of which is defined in the one of the cylinder bores by the associated piston. The rotary valve is housed in a central bore which is provided in the housing, and is rotated integrally with the rotary shaft. A suction port for allowing the compression chamber to communicate with the central bore is formed inside the housing. A refrigerant supply passage, which is selectively allowed to communicate with the suction port, is formed in the rotary valve. During the suction stroke of each single headed piston, namely, when the piston is moved toward the bottom dead center from the top dead center, the refrigerant supply passage of the rotary valve communicates with the suction port to allow the refrigerant gas to flow into the compression chamber.

However, in the compressor disclosed in Japanese Patent Laid-Open No. 7-189902, the refrigerant gas which is compressed in the cylinder bores (compression chambers) leaks out of a clearance between the outer circumference surface of the rotary valve and the inner circumference surface of the central bore, and thus the compression efficiency is reduced.

BRIEF SUMMARY OF THE INVENTION

An objective of the present invention is to provide a swash plate type compressor having excellent compression efficiency, thereby improving the sealing performance between the rotary valve and the housing.

In order to attain the above objective, the present invention provides a swash plate type compressor having a crank chamber defined in a housing, a swash plate mounted on a shaft extending in the crank chamber for the integral rotation, and a compression chamber defined in a cylinder bore by a piston coupled to the swash plate. The rotation of the swash plate allows the piston to reciprocatingly move linearly inside the cylinder bore to compress a refrigerant gas introduced into the compression chamber from a first area dominated by suction pressure and discharge the compressed refrigerant gas into a second area dominated by discharge pressure. The refrigerant gas contains oil that lubricates an interior of the compressor as the refrigerant gas flows therethrough. The compressor comprises a bleeding channel formed within the shaft; a rotary valve integrally rotatable with the shaft and disposed in an accommodating bore existing on an extension line of the shaft, wherein the rotary valve has an outer circumference surface and a suction passage rotated integrally with the shaft and allowing the cylinder bore and the first area to communicate with each other according to the rotation, wherein the suction passage communicates with the accommodating bore; an oil separator having a front end and a rear end and disposed on the bleeding channel, wherein the oil separator forms part of the bleeding channel and has a shape adapted to centrifuge the oil contained in the refrigerant gas passing therethrough by the rotation of the shaft; and a feeding passage for feeding the centrifuged oil to an interface between the outer circumference surface of the rotary valve and an inner circumference surface of the accommodating bore.

In the swash plate type compressor of the present invention, the accommodating bore has an inner wall that is close to the outer circumference surface of the rotary valve, and the bleeding channel through the oil separator is flared toward downstream from upstream of a refrigerant gas flow flowing therethrough, whereby the oil contained in the refrigerant gas passing through the oil separator is centrifuged from the refrigerant gas according to the rotation of the shaft. The compressor further comprises a feeding passage for feeding the centrifuged oil to an interface between the outer circumference surface of the rotary valve and the inner wall of the accommodating bore.

Other aspects and advantages of the invention will become apparent from the following description, taken in conjunction with the accompanying drawings, illustrating by way of example the principles of the invention.

BRIEF DESCRIPTION OF THE SEVERAL VIEWS OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
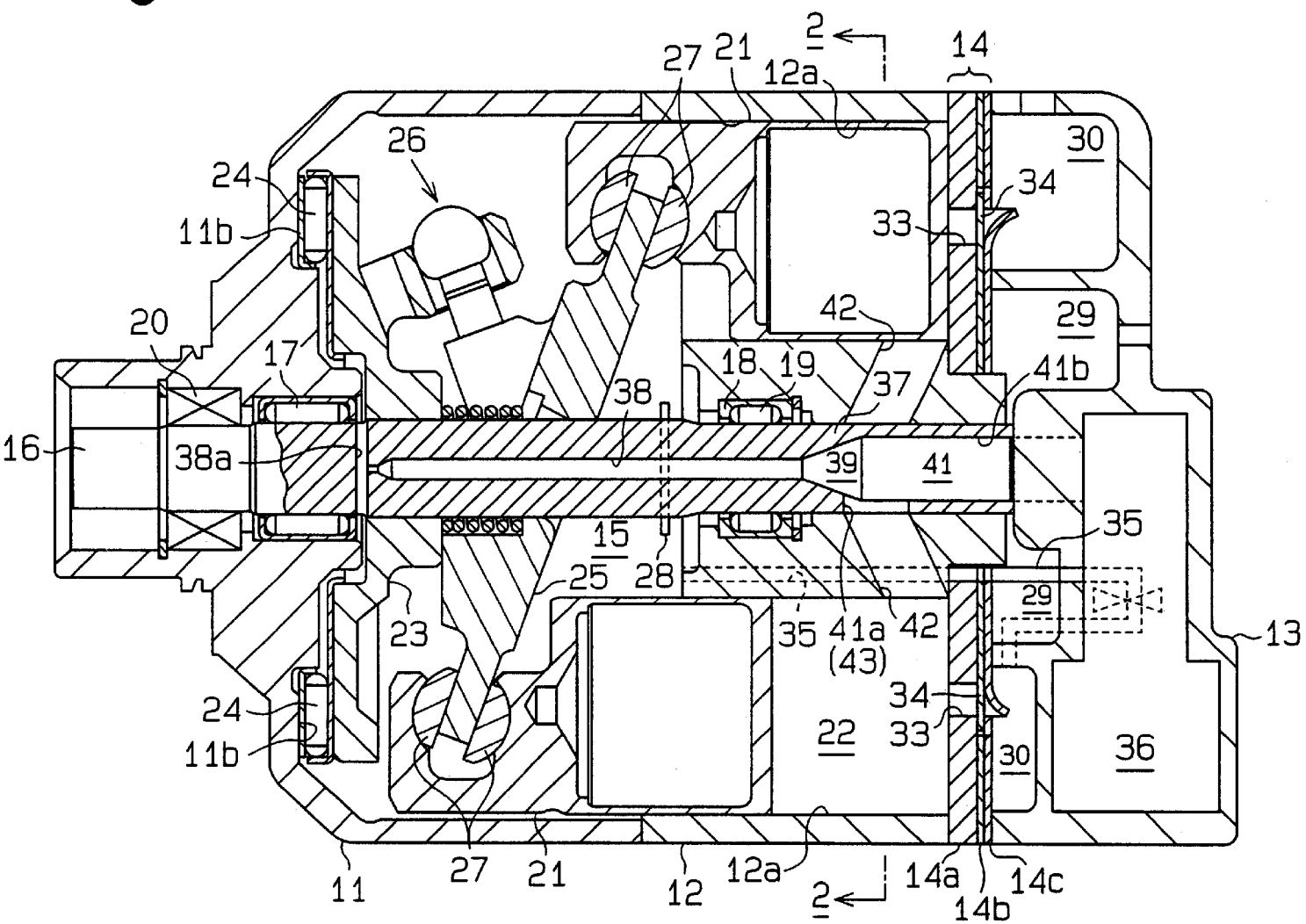
FIG. 1 is a cross-sectional view illustrating a compressor according to an embodiment of the present invention.
Figure 2:
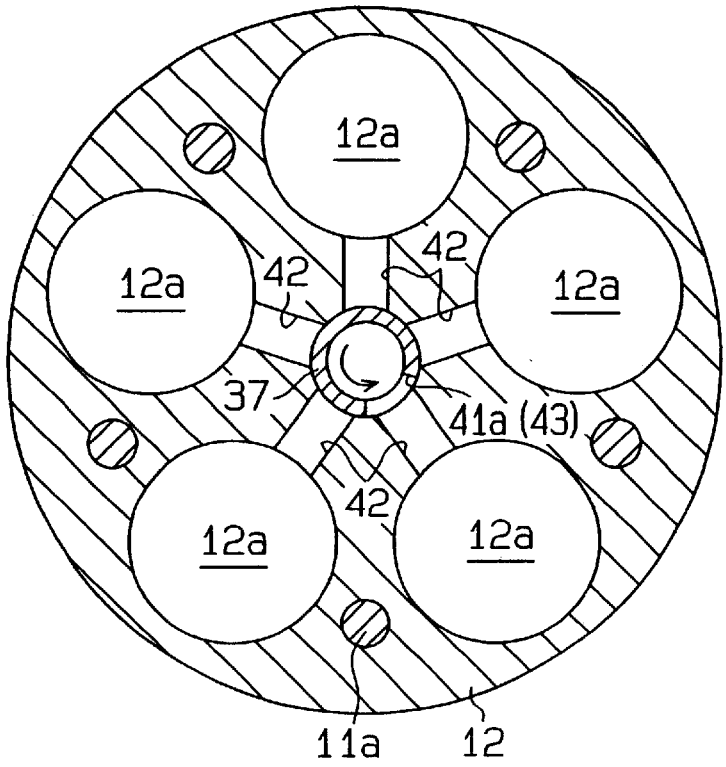
FIG. 2 is a sectional view taken along the line 2—2 in FIG. 1.
Figure 3:
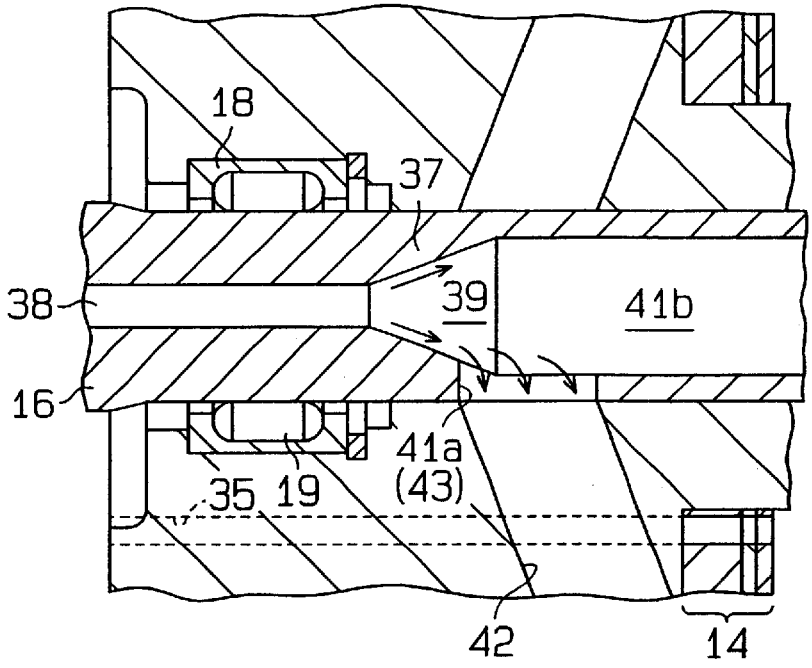
FIG. 3 is an enlarged cross-sectional view showing an essential part of the compressor in FIG. 1.

One embodiment of the present invention will be described with reference to FIGS. 1 to 3. In the embodiment of FIGS. 1 to 3, the present invention is embodied as a swash plate type compressor used in an air conditioner for a vehicle.

As shown in FIG. 1, a front housing member 11 is connected to a front end of a cylinder block 12. A rear housing member 13 is connected to a rear end of the cylinder block 12 via a valve plate assembly 14. The front housing member 11, the cylinder block 12 and the rear housing member 13 are fixed with bolts 11*a* (see FIG. 2) to construct a housing of the compressor. The left side of FIG. 1 is assumed to be a front side and the right side thereof a rear side.

The valve plate assembly 14 includes a main plate 14*a*, a discharge valve plate 14*b*, and a retainer plate 14*c*. The discharge valve plate 14*b* is located on the rear surface of the main plate 14*a*. The retainer plate 14*c* is located on the rear surface of the discharge valve plate 14*b*. The discharge valve plate 14*b* and retainer plate 14*c* are overlaid each other. The valve plate assembly 14 is connected to the cylinder block 12 on the front surface of the main plate 14*a*.

A crank chamber 15 is defined and formed between the front housing member 11 and the cylinder block 12. A shaft 16 extends through the crank chamber 15, and is rotatably supported between the front housing member 11 and the cylinder block 12. A front end portion of the shaft 16 is supported at the front housing member 11 with a first radial bearing 17. A central bore 18 as an accommodating bore is penetratingly provided in substantially the center of the cylinder block 12. A rear end portion of the shaft 16 is supported by a second radial bearing 19 contained in the central bore 18. A shaft seal 20 is provided at the front end portion of the shaft 16.

A plurality of cylinder bores 12*a* (only two of them are shown in the drawing) are formed in the cylinder block 12 disposed concentrically about the shaft 16. The cylinder bores are equiangularly spaced. A single headed piston 21 is housed in each of the cylinder bores 12*a* so as to be able to reciprocate therethrough. A front and a rear of each cylinder bore 12*a* are closed by the associated piston 21 and the valve plate assembly 14, thereby defining a compression chamber 22 in the cylinder bore 12*a*, which changes in volume corresponding to reciprocating motion of the piston 21.

A lug plate 23 is fixed to the shaft 16 so that the lug plate 23 rotates integrally with the shaft 16 in the crank chamber 15. The lug plate 23 abuts against an inner wall surface 11*b* of the front housing member 11 with a thrust bearing 24. The inner wall surface 11*b* bears a load applied to the shaft 16 caused by a reaction force acting on the piston 21 at the time of a compression operation, and restrains slide of the shaft 16 to the front side.

A swash plate 25 is supported in the crank chamber 15 by the shaft 16 extending through a hole formed in the swash plate 25. In addition, the swash plate 25 is linked with the lug plate 23 by a hinge mechanism 26. As a result, the swash plate 25 is rotated together with the lug plate 23, which is rotated integrally with the shaft 16. Further, the swash plate 25 slidably moves along the shaft 16 in the axial direction. The swash plate 25 is tiltable with respect to the shaft 16 while the sliding.

The pistons 21 are coupled to the circumferential edge of the swash plate 25 with shoes 27. Accordingly, rotational movement of the swash plate 25 caused by the rotation of the shaft 16 is converted into the reciprocating motion of the pistons 21 by the shoe 27.

A stopper 28 is placed between the swash plate 25 and the cylinder block 12 on the shaft 16. The stopper 28 is constituted by a ring-shaped member fitted onto an outer circumference surface of the shaft 16. A minimum tilt angle of the swash plate 25 is defined by abutting against the stopper 28, and a maximum tilt angle of the swash plate 25 is defined by abutting against the lug plate 23.

As shown in FIG. 1, a suction chamber 29 and a discharge chamber 30 are defined in the rear housing member 13. Discharge ports 33 and discharge valve flaps 34 for opening and closing the discharge ports 33 are formed in the valve plate assembly 14. Each discharge port 33 and the associated discharge valve flap 34 correspond to one of the cylinder bores 12*a*. Each of the cylinder bores 12*a* communicates with the discharge chamber 30 through the corresponding discharge port 33. The suction chamber 29 and the discharge chamber 30 are connected by an external refrigerant circuit (not shown).

The cylinder block 12 and the rear housing member 13 are provided with a supply passage 35, which allows the crank chamber 15 and the discharge chamber 30 to communicate with each other. A control valve 36 is provided along the supply passage 35. The control valve 36 includes a conventional solenoid valve. A valve chamber is formed in the supply passage 35, so that the supply passage 35 is closed by energizing of the solenoid, and the supply passage 35 is opened by deenergizing of the solenoid.

The opening amount of the valve is adjustable according to the magnitude of the exciting current to the solenoid. The control valve 36 also functions as a throttle.

A rotary valve 37 is formed at a rear end portion of the shaft 16. The shaft 16 and the rotary valve 37 are integrally formed. Accordingly, the rotary valve 37 is integrally rotated with the shaft 16 when the shaft 16 is rotated. A bleeding channel 38 is formed inside the shaft 16 and the rotary valve 37. The rear end portion of the bleeding channel 38, namely, substantially a center portion of the rotary valve 37 is tapered so that the diameter increases rearward, to define an oil separator 39. The oil separator 39 separates oil mixed in the refrigerant gas. The oil separator 39 is flared toward the rear end from the front end, namely, toward a downstream side from an upstream side of the flow of the refrigerant gas from the crank chamber 15 to the suction chamber 29. Accordingly, the oil separator 39 becomes larger in the sectional area toward the downstream side from the upstream of the flow of the refrigerant gas. The inner diameter of the oil separator 39 is formed to be the largest at the rear end. A certain kind of oil in an atomized form is generally added to the refrigerant gas for the purpose of lubricating the components of the compressor.

The bleeding channel 38 has an inlet port 38*a* formed behind the first radial bearing 17. The rear end of the oil separator 39 in the bleeding channel 38 communicates with a communication chamber 41*b* with the same diameter as the maximum diameter of the separator 39. The communication chamber 41*b* and the suction chamber 29 communicate with each other so that the refrigerant gas can flow therein. Thus, the bleeding channel 38 serves as a bleeding passage which allows the crank chamber 15 and the suction chamber 29 to communicate with each other.

A suction port 41*a* communicating with the bleeding channel 38 is formed in the rotary valve 37 integrated with the shaft 16 as shown in FIG. 1. Suction channels 42 of the cylinder bores 12*a* communicate with the suction port 41*a* in succession according to the rotation of the shaft 16 and the rotary valve 37 in the direction of the arrow in FIG. 2. A suction passage 41 is constructed by the suction port 41*a* and the communication chamber 41*b*.

The suction passage 41 extends rearward from the rear end portion (downstream) of the oil separator 39. Each suction channel 42 is formed inside the cylinder block 12, and one end thereof communicates with the one of the cylinder bores 12*a*, and the other end thereof is disposed at the position corresponding to the suction port 41*a*. When the rotary valve 37 is rotated, the suction channel 42 of the cylinder bore 12*a* at the suction stroke communicates with the suction passage 41, and the suction channel 42 of the cylinder bore 12*a* at the compression and discharge stroke does not communicate with the suction passage 41. At this time, sliding surfaces (seal region) between the rotary valve 37 and the cylinder block 12 are completely sealed.

Now an operation of the compressor constructed as described above will be explained.

When the shaft 16 is rotated, the swash plate 25 is rotated integrally with the shaft 16 with the lug plate 23 and the hinge mechanism 26. The rotation of the swash plate 25 is converted into the reciprocation of each piston 21 by the shoes 27. By continuing such a series of operation, suction, compression and discharge of the refrigerant are successively repeated in each compression chamber 22. The refrigerant supplied into the suction chamber 29 dominated by suction pressure (first pressure) from an external refrigerant circuit is drawn into each compression chamber 22, and is subjected to a compression action by the movement of the associated piston 21. Then, the compressed refrigerant is discharged into the discharge chamber 30 via the corresponding discharge port 33, dominating the discharge chamber 30 with discharge pressure (second pressure) that is higher than the first pressure. The refrigerant discharged into the discharge chamber 30 is fed to the external refrigerant circuit via the discharge passage.

The opening amount of the control valve 36, or the opening amount of the supply passage 35 is adjusted according to the load exerted onto the external refrigerant circuit, namely, the demanded cooling performance by a controller (not shown). As a result, a communication state between the discharge chamber 30 and the crank chamber 15 is changed.

When the load on the external refrigerant circuit is great, the opening amount of the supply passage 35 is decreased, and the flow of the refrigerant gas supplied into the crank chamber 15 from the discharge chamber 30 is decreased. When the flow rate of the refrigerant gas supplied to the crank chamber 15 is decreased, the pressure of the crank chamber 15 is gradually reduced by release of the refrigerant gas into the suction chamber 29 via the bleeding channel 38 and the like. As a result, the difference between the pressure inside the crank chamber 15 and the pressure inside the cylinder bores 12*a* via the pistons 21 becomes small, and therefore the tilt angle of the swash plate 25 with respect to the shaft 16 is increased. Accordingly, the stroke amount of the pistons 21 is increased and the displacement is also increased.

On the other hand, when the load on the external refrigerant circuit becomes small, the opening amount of the control valve 36 is increased. Thus, the flow rate of the refrigerant gas supplied to the crank chamber 15 from the discharge chamber 30 is increased. When the flow rate of the refrigerant gas supplied to the crank chamber 15 exceeds the flow rate of the released refrigerant gas to the suction chamber 29 via the bleeding channel 38, the pressure in the crank chamber 15 gradually rises. As a result, the difference between the pressure in the crank chamber 15 and the pressure in the cylinder bores 12*a* via the pistons 21 becomes large, and therefore the tilt angle of the swash plate 25 with respect to the shaft 16 is decreased. Accordingly, the stroke amount of the pistons 21 is decreased and the discharge capacity is also decreased.

In the refrigerant gas flow introduced into the suction chamber 29 via the bleeding channel 38, the flow in the vicinity of the inner circumference surface of the oil separator 39 is swirled following the rotation of the oil separator 39. By this swirling, the oil mixed in the refrigerant gas is centrifuged from the refrigerant gas. The centrifuged oil adheres to the inner circumference surface of the oil separator 39, and then is moved rearward along the inner circumference surface of the oil separator 39. Subsequently, the oil is discharged to the suction passage 41 from the oil separator 39 by the centrifugal force based on the rotation of the oil separator 39. The centrifuged oil is moved in the direction of the arrow in FIG. 3.

The oil supplied into the suction passage 41 is supplied to the clearance between the rotary valve 37 and the cylinder block 12. The suction passage 41 successively communicates with the suction channels 42 according to the rotation of the shaft 16 and the rotary valve 37, whereby the oil is supplied into the clearance between each piston 21 and the corresponding cylinder bore 12*a*. That is, the suction port 41*a* serves as an oil feeding passage 43 for the clearance between each piston 21 and the corresponding cylinder bore 12*a* in this embodiment.

A part of the refrigerant gas from which the oil is separated in the oil separator 39 is introduced into the suction chamber 29 through the communication chamber 41*b*. The refrigerant gas introduced into the suction chamber 29 (the content of the oil in this gas is small) is discharged to the external refrigerant circuit through the compression chambers 22 and the discharge chamber 30.

As described above, the oil mixed in the refrigerant gas is separated by using the oil separator 39 provided inside the integrated structure of the rotary valve 37 and the shaft 16. The separated oil is supplied into the clearance between the rotary valve 37 and the cylinder block 12, and then reduces friction between the rotary valve 37 and the cylinder block 12. Further, since the oil gathered between the outer circumference surface of the rotary valve 37 and the inner circumference surface of the cylinder block 12 shields the gas, the gas is prevented from passing the clearance and leaking out. Accordingly, the gas to leak out of the compression chambers 22 is effectively shielded, which improves the compression efficiency of the compressor.

The suction passage 41 and each suction channel 42 are communicated with each other by rotation of the rotary valve 37. And the oil separated by the oil separator 39 is supplied to the clearance between each piston 21 and the associated cylinder bore 12*a* via the suction passage 41 and the associated suction channel 42. Thus, the leakage of the gas from the clearance is prevented.

In addition, an oil separation mechanism is constructed by using a part of the bleeding channel 38 formed inside the shaft 16. This prevents the compressor from being larger due to addition of the oil separation mechanism.

The inner circumference surface of the oil separator 39 is tilted so that the inner diameter becomes larger at the downstream as compared with the upstream of the flow of the refrigerant gas passing through the inside of the oil separator 39. This facilitates the oil adhering to the inner circumference surface of the oil separator 39 to be discharged outside from the oil separator 39 by a centrifugal force at the time of rotation of the shaft 16.

It should be apparent to those skilled in the art that the present invention may be embodied in many other specific forms without departing from the spirit or scope of the invention. Particularly, it should be understood that the invention may be embodied in the following forms.

Figure 4:
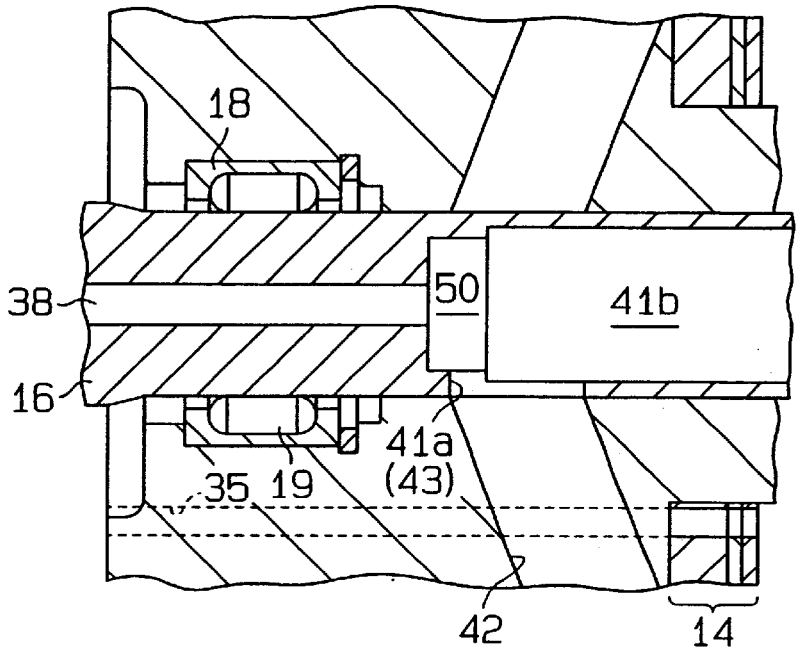
FIG. 4 is an enlarged sectional view showing an essential part of a compressor of an alternative embodiment.

The oil separator may not be formed to have the inner circumference surface which is tilted such that its inner diameter is larger at the downstream side as compared with at the upstream side. For example, as shown in FIG. 4, the oil separator 39 may be formed such that the inner diameter to be adhered with the oil is constant from the upstream to the downstream.

Figure 5:
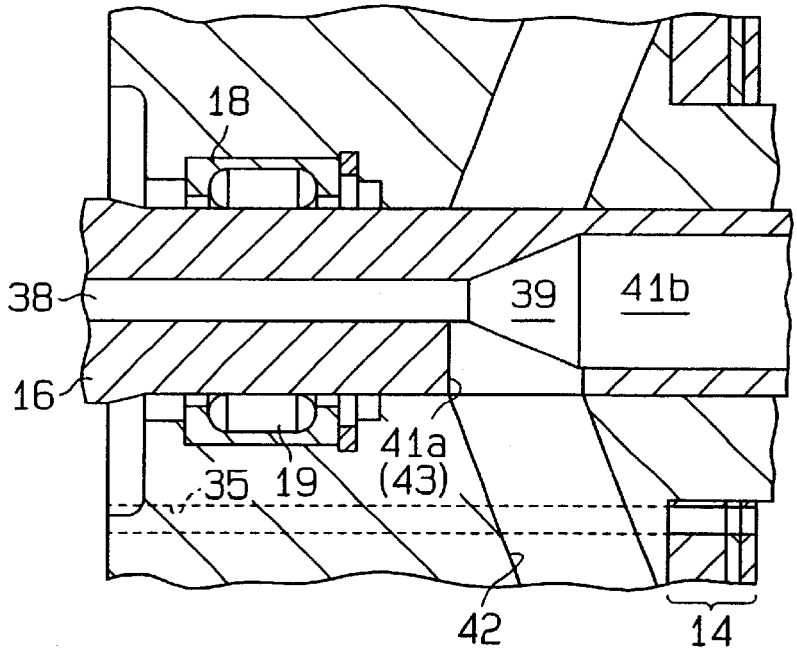
FIG. 5 is an enlarged cross-sectional view showing an essential part of a compressor of another alternative embodiment.

The suction passage need not be provided at the rear side than the oil separator with respect to the shaft. For example, as shown in FIG. 5, the suction passage 41 may be provided at the same position as the oil separator 39 or at the upstream than the oil separator 39 with respect to the shaft 16. With such a configuration, the centrifuged oil is also supplied to the suction passage 41.

Figure 6:
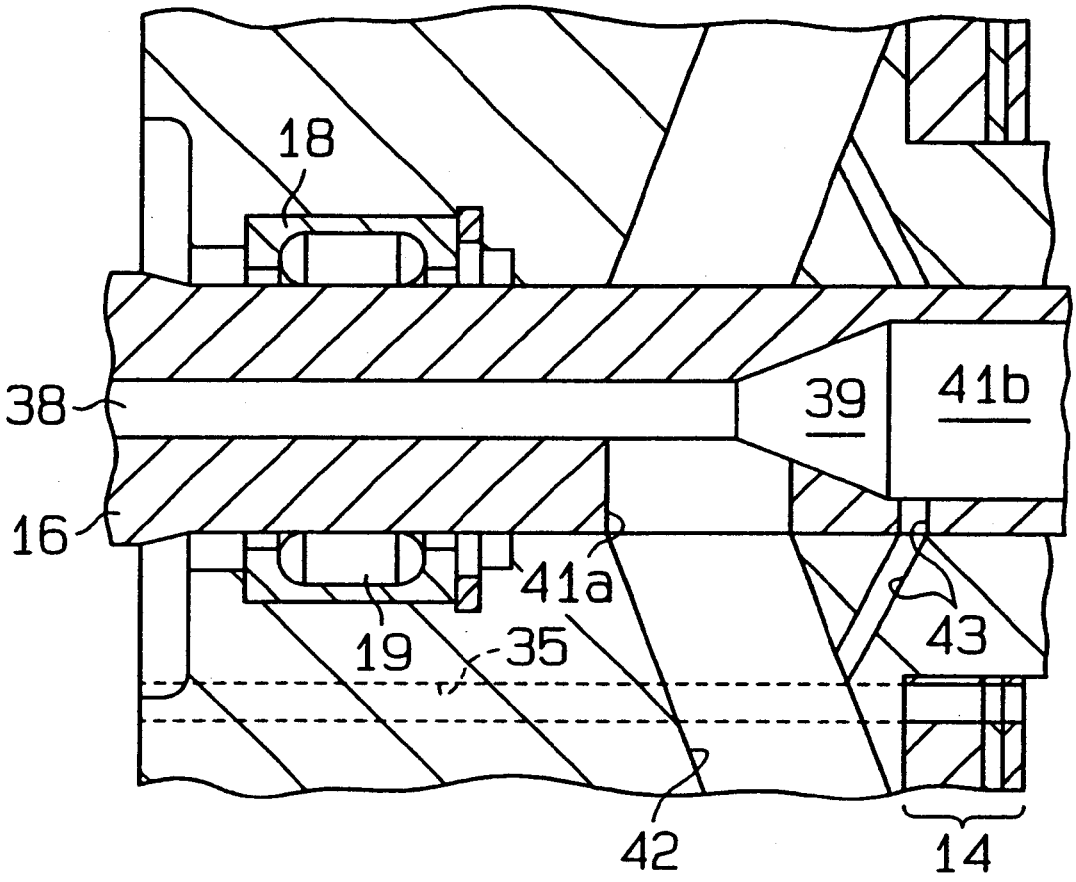
FIG. 6 is an enlarged sectional view showing an essential part of a compressor of another alternative embodiment.

An oil feeding passage for supplying the oil may be provided separately from the suction passage. For example, as shown in FIG. 6, aside from the suction passage 41, a separate oil feeding passage 43 may be provided in the cylinder block 12 and the rotary valve 37 for supplying the separated oil. According to such a configuration, the centrifuged oil can be supplied to between the rotary valve 37 and the cylinder block 12, and between each piston 21 and the associated cylinder bore 12*a* from the oil feeding passage 43.

The oil feeding passage 43 is connected to a point along the suction channel 42 in FIG. 6, but the oil feeding passage 43 may be directly connected to the cylinder bore 12*a*.

In the illustrated embodiment, the suction chamber 29 is provided within the rear housing member 13, but the suction chamber 29 may be omitted, and the refrigerant may be directly introduced into the communication chamber 41*b*.

The bleeding channel 38 may be a groove formed in the outer circumference of the shaft, although the bleeding channel 38 is formed in the shaft 16 in the embodiment.

The oil separator need not have a tapered side cross-section.

The rotary valve is not limited to an integral construction with the shaft. The rotary valve may be a separate component installed in the shaft.

The oil separator according to the present invention may be embodied in a wobble plate type variable displacement compressor.

Therefore, the present examples and embodiments are to be considered as illustrative and not restrictive and the invention is not to be limited to the details given herein, but may be modified within the scope and equivalence of the appended claims.

What is claimed is:

1. A swash plate type compressor having a crank chamber defined in a housing, a swash plate mounted on a shaft extending in the crank chamber for the integral rotation, and a compression chamber defined in a cylinder bore by a piston coupled to the swash plate, wherein the rotation of the swash plate allows the piston to reciprocatingly move linearly inside the cylinder bore to compress a refrigerant gas introduced into the compression chamber from a first area dominated by suction pressure and discharge the compressed refrigerant gas into a second area dominated by discharge pressure, wherein the refrigerant gas contains oil that lubricates an interior of the compressor as the refrigerant gas flows therethrough, comprising:

a bleeding channel formed within the shaft;

a rotary valve integrally rotatable with the shaft and disposed in an accommodating bore existing on an extension line of the shaft, wherein the rotary valve has an outer circumference surface and a suction passage rotated integrally with the shaft and allowing the cylinder bore and the first area to communicate with each other according to the rotation, wherein the suction passage communicates with the accommodating bore;

an oil separator having a front end and a rear end, and disposed on the bleeding channel, wherein the oil separator forms part of the bleeding channel and has a shape adapted to centrifuge the oil contained in the refrigerant gas passing therethrough by the rotation of the shaft, and the oil separator is configured such that the bleeding channel extending through the oil separator is flared toward downstream from upstream of a refrigerant flow flowing in the bleeding channel; and a feeding passage for feeding the centrifuged oil to an interface between the outer circumference surface of the rotary valve and an inner circumference surface of the accommodating bore.

2. The swash plate type compressor according to claim 1, wherein the cylinder bore further comprises a suction channel communicable with the suction passage, and a communication of the feeding passage with the suction channel allows the centrifuged oil to be supplied between the piston and the cylinder bore.

3. The swash plate type compressor according to claim 1, wherein the feeding passage is disposed at a downstream side from the oil separator with respect to the flow of the refrigerant gas in the bleeding channel.

4. The swash plate type compressor according to claim 1, wherein the bleeding channel forms a passage for releasing pressure in the crank chamber to the first area.

5. The swash plate type compressor according to claim 1, wherein the suction passage comprises a suction port to be aligned with the suction channel for communicating and a communication chamber adjacent the first area, the suction port also serves as the feeding passage.

6. A swash plate type compressor having a crank chamber defined in a housing, a swash plate provided on a shaft extending in the crank chamber for the integral rotation, a compression chamber defined in a cylinder bore by a piston coupled to the swash plate, wherein the rotation of the swash plate allows the piston to reciprocatingly move linearly inside the cylinder bore to compress a refrigerant gas introduced into the compression chamber from a first area dominated by suction pressure and discharge the compressed refrigerant gas into a second area dominated by discharge pressure, wherein the refrigerant gas contains oil that lubricates an interior of the compressor as the refrigerant gas flows therethrough, comprising:

a bleeding channel formed within the shaft;

a rotary valve integrally rotatable with the shaft and disposed in an accommodating bore existing on an extension line of the shaft, wherein the rotary valve has an outer circumference surface and a suction passage rotated integrally with the shaft and allowing the cylinder bore and the first area to communicate with each other according to the rotation, wherein the suction passage communicates with the accommodating bore, wherein the accommodating bore has an inner wall that is close to the outer circumference surface of the rotary valve;

an oil separator having a front end and a rear end and disposed on the bleeding channel, wherein the oil separator forms part of the bleeding channel, and wherein the bleeding channel through the oil separator is flared toward downstream from upstream of a refrigerant gas flow flowing therethrough, whereby the oil contained in the refrigerant gas passing through the oil separator is centrifuged from the refrigerant gas according to the rotation of the shaft; and a feeding passage for feeding the centrifuged oil to an interface between the outer circumference surface of the rotary valve and the inner wall of the accommodating bore.

7. The swash plate type compressor according to claim 6, wherein the feeding passage is disposed at the downstream side from the oil separator with respect to the flow of the refrigerant gas in the bleeding channel.

8. The swash plate type compressor according to claim 6, wherein the bleeding channel forms a passage for releasing pressure in the crank chamber to the first area.

9. The swash plate type compressor according to claim 6, wherein the suction passage comprises a suction port to be aligned with the suction channel for communicating and a communication chamber adjacent the first area, the suction port also serves as the feeding passage.

* * * * *